US008785825B2

(12) United States Patent
Peck

(10) Patent No.: US 8,785,825 B2
(45) Date of Patent: Jul. 22, 2014

(54) SUPPORT STRUCTURE FOR HEATING ELEMENT COIL

(75) Inventor: Kevin B. Peck, Sonora, CA (US)

(73) Assignee: Sandvik Thermal Process, Inc., Sonora, CA (US)

( * ) Notice: Subject to any disclaimer, the term of this patent is extended or adjusted under 35 U.S.C. 154(b) by 342 days.

(21) Appl. No.: 13/168,662

(22) Filed: Jun. 24, 2011

(65) Prior Publication Data

US 2011/0315673 A1 Dec. 29, 2011

Related U.S. Application Data

(60) Provisional application No. 61/358,694, filed on Jun. 25, 2010.

(51) Int. Cl.
*H05B 3/06* (2006.01)
*H05B 3/66* (2006.01)

(52) U.S. Cl.
USPC ..... 219/532

(58) Field of Classification Search
USPC ..... 219/385, 39–1, 405, 411, 402, 483, 219/531–2, 536, 542; 373/128, 5, 130, 112, 373/109, 117–19, 127, 129, 137; 29/611
See application file for complete search history.

(56) References Cited

U.S. PATENT DOCUMENTS 5,038,019 A 8/1991 McEntire et al.
5,095,192 A * 3/1992 McEntire et al. ..... 219/402
5,187,771 A 2/1993 Uchida
5,229,576 A 7/1993 Nakao et al.
6,807,220 B1 10/2004 Peck
7,145,932 B2 12/2006 Sakaguchi et al.
2008/0296282 A1* 12/2008 Kobayashi et al. ..... 219/385
2009/0194521 A1 8/2009 Kobayashi et al.

FOREIGN PATENT DOCUMENTS

JP 63-145291 9/1988

OTHER PUBLICATIONS

Partial European Search Report for European Application 11171423.4, dated Jun. 6, 2012.
Extended European Search Report for European Application 11171423.4, dated May 29, 2012.

* cited by examiner

*Primary Examiner* — Shawntina Fuqua
(74) *Attorney, Agent, or Firm* — Morgan, Lewis & Bockius LLP

(57) ABSTRACT

Spacer for a vertical support structure of a heating element coil includes a mating feature including complimentary components on first opposing sides of the spacer, a cavity, open to second opposing sides of the spacer, and an extension offset from an axis intersecting the mating features, the extension including a pocket sized to fit an individual loop of the heating element coil. The spacer can be incorporated into a support structure for a heating element coil interlocking adjacent loops of the coil so that they are retained in a collinear and concentric arrangement while allowing the loops of the coil to move freely inward and outward from the central axis in unison.

26 Claims, 7 Drawing Sheets

FIG. 4
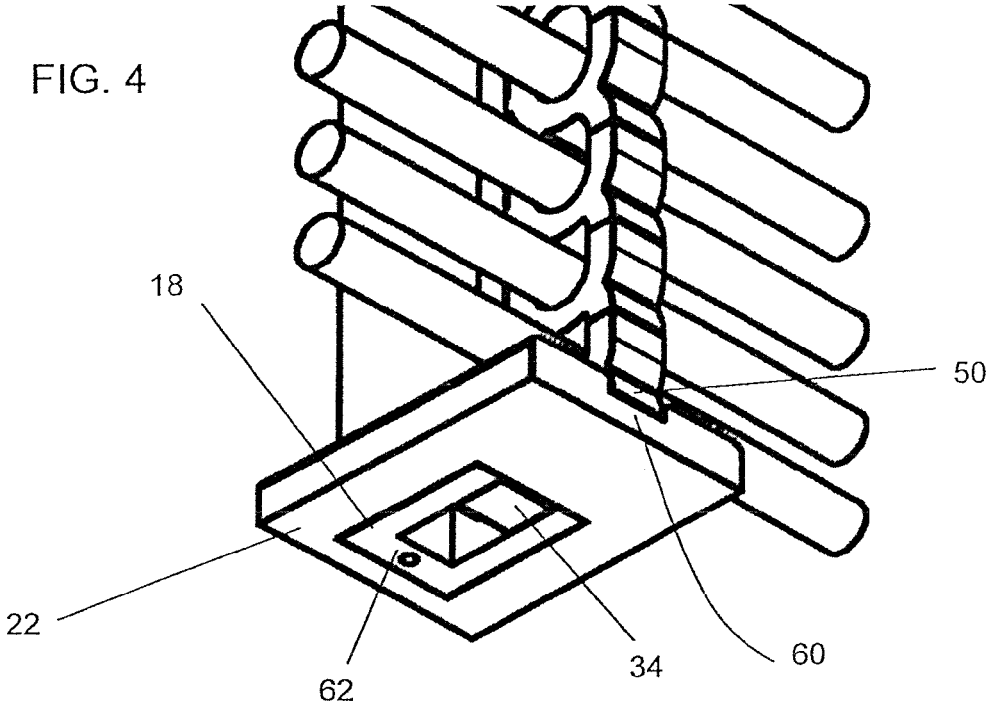
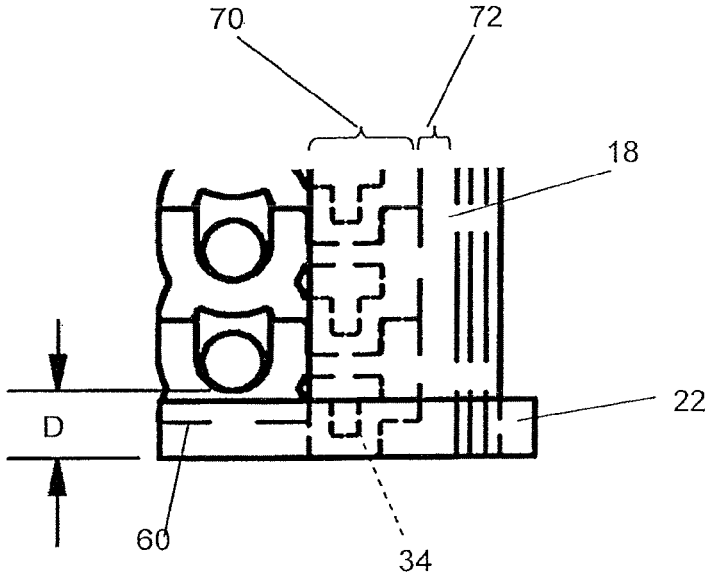
FIG. 5

SUPPORT STRUCTURE FOR HEATING ELEMENT COIL

RELATED APPLICATION DATA

This application claims priority under 35 U.S.C. §119(e) to U.S. Provisional Application No. 61/358,694, filed Jun. 25, 2010, entitled "Support Structure For Heating Element Coil", the entire contents of which are incorporated herein by reference.

FIELD

The present disclosure relates to a support structure for a coiled heating element. In particular, the present disclosure relates to a spacer, having cooperating mating features and arranged in a vertical stack which maintains one or more of the collinearity, concentricity and centering of the heating element coil during thermal expansion of the heating element. The present disclosure also relates to a support structure including such a spacer, such as a support structure in a furnace for processing semiconductor components, and a method of supporting a coiled heating element with such a spacer.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Metallic resistance alloy is a dominant material used in the construction in electrical heating element assemblies. Typical FeCrAl alloys achieve their high temperature stability and long life by creating a protective oxide coating on the outer surfaces. This oxide layer contributes to the material's hot strength as well as protecting the core alloy from the formation of other oxides and nitrides that would rapidly consume the wire. The protective oxide layer is formed via the oxidation of aluminum inclusive in the heating alloy. One of the known properties of the FeCrAl resistance alloy is permanent elongation over time. Elongation is primarily caused when during thermal cycling of the alloy. The wire expands as it is heated, the oxide coefficient of expansion is less than the metal core, tensile stresses are created in the oxide coating and therefore cracks form in the oxide surface. The newly exposed alloy creates more oxide on the exposed areas and "heals" the surface. When the wire is cooled, compressive forces are created from the difference in thermal expansion from the alloy and the oxide. The compressive forces cause some of the oxide to flake or "spall" off of the material. Some portion of the elongation becomes permanent and the effect is cumulative over time.

Various improvements (such as powdered metallurgy) have been developed to minimize the permanent elongation characteristics of the alloy. It has been found that minimizing the stresses induced in the alloy helps reduce the elongation and generally extends element life. One source of stresses introduced into the wire is the force created when the helical coil of wire expands and pushes against the thermal installation surrounding the element assembly. Various approaches have been taken to attempt to mitigate this situation. Leaving a small space between the wire and insulation provides room for the coils to expand, but these designs do not address the issue of collinearity and concentricity of the coils. These prior art methods generally rely on some form of slot in the ceramic spacer rows that allow for expansion and contraction (as well as permanent elongation), but no mechanism is provided to insure the collinearity and concentricity of the coils. Since these assemblies are vertically mounted, gravity creates a downward force on the coil turns and encouraging the lower portions of the coil to increase in diameter, while the upper turns constrict. This can lead to increased forces applied to the bottom turns prior to the upper portion, leading to accelerated aging in the lower portions. Also, increased forces can be experienced at locations like the power terminals where the coils are somewhat fixed in location and the additional downward force from gravity is exerted. Some prior art attempts to remedy this situation by attaching protrusions to the heating element coils to block them from passing through the spacer assemblies. This can help and mitigate the accumulation of material in the lower part of the assembly but has negative implications to the heating wire temperature uniformity and potential risk of failure. Furthermore, these methods do not address the issue of keeping the coils collinear and centered. There is no constraining mechanism that keeps the coils collinear, therefore one coil can move horizontally relative an adjacent coil leading to irregular distribution of the heating element surface along the vertical axis. This can lead to decreased temperature uniformity within the heating element. Once deformation of the coil is initiated at some point in the assembly, it generally continues to worsen over time at that location. Therefore, the deformation can result in decreased element life as well.

Temperature uniformity and overall life can be affected by the centering of the coil within the assembly as well. The prior art does not provide a mechanism for maintaining the centering of the coil as well.

There is a need in the industry for an element assembly that allows the coil to move freely as it expands and contracts during thermal cycling while maintaining concentricity, collinearity and centering of the heating element coil.

SUMMARY

The exemplary embodiments overcome the problems and limitations of the prior art. For example, spacers interlocking the coil along the circumference in a series of columns and limiting the movement relative to adjacent turns in the heating element coil allows the turns of the coil to remain concentric and collinear. At the same time, the interlocked columns of spacers are allowed to slide inward and outward relative to the center of the coil assembly as the coil expands and contracts. This allows the coil to freely expand into the space provided between the outer diameter (OD) of the coil assembly and the inner diameter (ID) of the insulation.

The supports also can act as guides for the spacer columns, and the supports are preferentially arranged evenly around the circumference while being aligned with the center of the coil assembly. This creates vectors of force that encourage the coil assembly to remain centered within the heating element assembly.

An exemplary embodiment of a support structure for a heating element coil interlocking adjacent loops of the coil so that they are retained in a collinear and concentric arrangement while allowing the loops of the coil to move freely inward and outward from the central axis in unison comprises a plurality of vertical support column assemblies, each positioned around a circumference of the heating element coil, wherein the vertical support column includes of a plurality of individual spacers having a pitch, the vertical support column residing at least partially inside a vertical channel, and wherein the vertical support column moves slideably within the vertical channel.

An exemplary embodiment of a spacer for a vertical support structure of a heating element coil comprises a mating feature including complimentary components on first opposing sides of the spacer, a cavity, open to second opposing sides of the spacer, and an extension offset from an axis intersecting the mating features, the extension including a pocket sized to fit an individual loop of the heating element coil.

An exemplary embodiment of a method of controlling a position relative to a center position of a heating element coil upon heating comprises mounting individual loops of a heating element coil in a column of vertically stacked spacers, wherein an increase in a length of the heating element coil upon heating is accommodated by a radially outward movement of the spacers relative to the center position while cooperation of mating features on adjacent spacers are maintained.

It is to be understood that both the foregoing general description and the following detailed description are exemplary and explanatory and are intended to provide further explanation of the invention as claimed.

BRIEF DESCRIPTION OF THE DRAWINGS

The following detailed description can be read in connection with the accompanying drawings in which like numerals designate like elements and in which:

FIG. 4 is a detailed isometric view of the supporting member.

FIG. 5 is a side view of an embodiment of a support structure for a heating element coil.

DETAILED DESCRIPTION

Figure 1A:
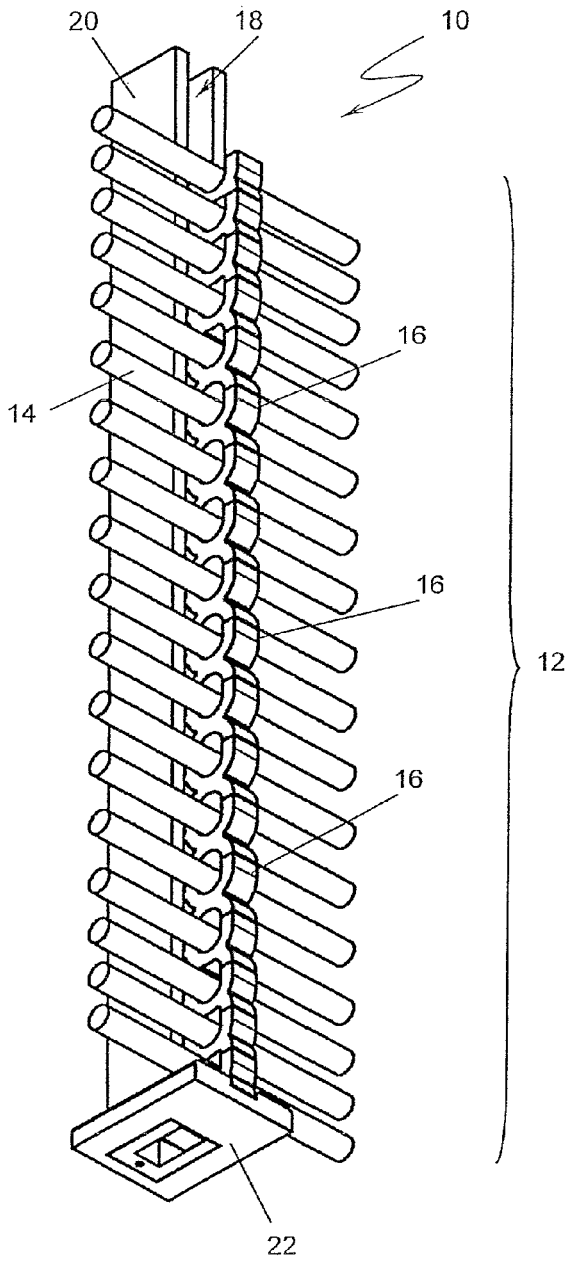
FIG. 1A is front isometric view of an embodiment of a support structure for a heating element coil.
Figure 1B:
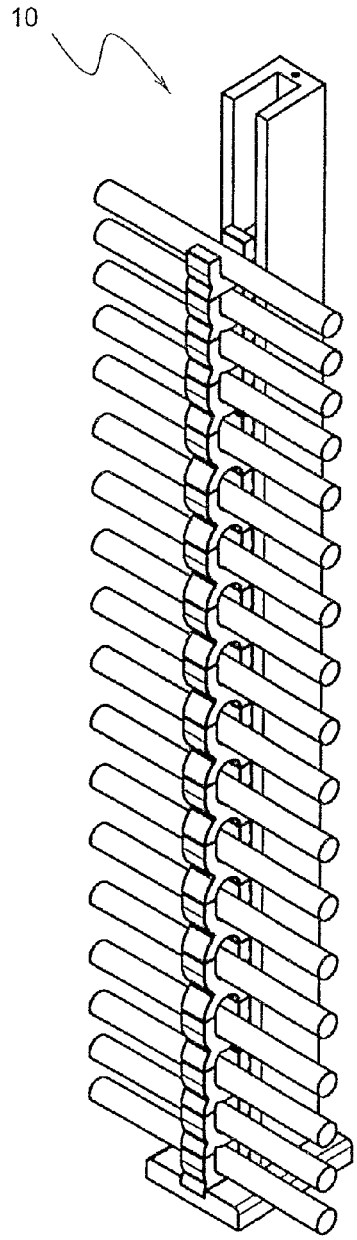
FIG. 1B is a back isometric view of the embodiment of a support structure for a heating element coil shown in FIG. 1A.

Referring to FIGS. 1A and 1B, an exemplary embodiment of a spacer assembly 10 includes rows of vertically stacked spacers 12 that provide support for the individual circular loops 14 of the vertically oriented coil. The vertically oriented coil is not shown in its entirety, but rather the individual circular loops 14 thereof are only shown in the area in which they interact with the spacer assembly 10 to allow viewing of the spacer assembly 10. The vertically stacked spacers 12 form a column 16 and can have various pitch dimensions that allow the spacing between the circular loops 14 of the coil to be adjusted to advantageously distribute the power dissipated by the coil in order to achieve a desired temperature profile characteristic. The lateral movement of any of the individual spacers 16 in the column 12 of vertically stacked spacers 16 is constrained by a vertical channel 18, for example a channel in a rail 20 or other constraining device, keeping the spacers 16 aligned while still allowing movement inward and outward within the confines of the channel 18. The vertical channel 18 can be a separate component as illustrated, or could be formed in whole or in part by incorporating a feature into the heater insulation. A spacer column support component 22 distributes the combined weight of the spacers 16 and coil across the supporting surface (not shown) and maintains the orientation of the channel 18 and the column 12 of vertically stacked spacers 16. A similar spacer column support component (not shown) is located at the top of the column 12 of vertically stacked spacers 16 to constrain the top of the spacer assembly.

Figure 2:
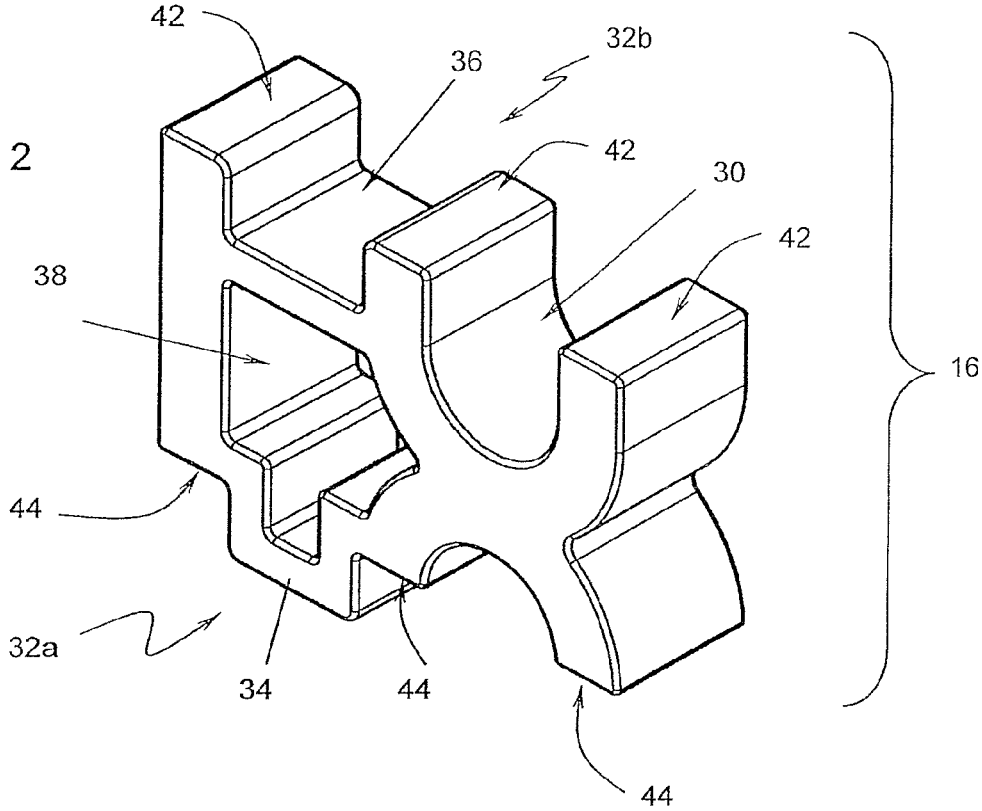
FIG. 2 is a detailed isometric view of a large-pitch spacer.

Now referring to FIG. 2, each spacer 16 is constructed such that it has a pocket 30 in which the circular loop 14 of the vertically oriented coil is captured and supported. The spacer also has a mating feature 32*a*,32*b*, such as a protrusion 34 that mates with a recess 36 on an adjacent spacer when placed in the column 12 of vertically stacked spacers 16. The mating features 32*a*,32*b* in the adjacent spacers work in conjunction with gravity and the weight of the coil to interlock the adjacent spacers in contiguous vertical relationship, such as a column 12. Other vertical relationships are also possible, including, for example, staggered, alternating and step-wise or stair-wise. The mating features 32*a*,32*b* may simply nest together to facilitate easy assembly, but alternatively the mating feature 32*a*,32*b* could be modified into a more positive locking method like a "dove tail" or can incorporate a fastener if desired without deviating from the spirit of the invention.

Alternately, the protrusion 34 at the end of a column 12 may mate with a portion of the column support component 22 or the recess 36 may mate with a portion of the opposite column support component. Central cavity 38 traverses at least some, alternatively all, of the width of the spacer and is incorporated to reduce the overall mass of the spacer 16, which in turn reduces the energy required to heat the spacer 16 and the energy storage in the spacer 16, which can affect the rate that the spacer 16 cools.

The spacer 16 depicted in FIG. 2 is typical of one with a larger pitch dimension. The pitch dimension is defined by the distance from the plane containing the top flat surfaces 42 to the plane containing the bottom flat surfaces 44, exclusive of the protrusion 34. The pitch dimension in turn determines the distance between individual circular loops 14 in the coil assembly.

Figure 3:
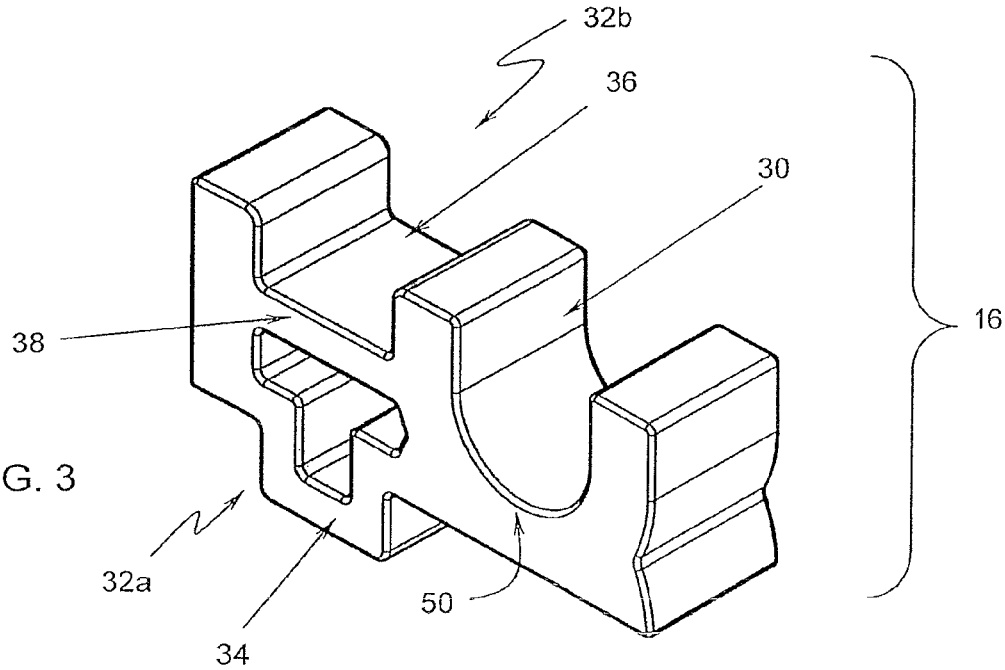
FIG. 3 is a detailed isometric view of a small pitch spacer.

FIG. 3 depicts another exemplary embodiment of a spacer 16 with a smaller pitch dimension. It consists of the same basic features as the larger pitch spacer 16 depicted and described in connection with the spacer 16 in FIG. 2. Namely, these features include a pocket 30, a mating feature 32*a*.32*b* with a protrusion 34 and a recess 36, and central cavity 38. The notable difference in the embodiment of the spacer in FIG. 3 in comparison to that depicted in FIG. 2 is that the spacer 16 in FIG. 3 has a flat base 50 that can be used to mate to the spacer column support component 22. The flat base 50 provides additional surface area for support of the spacer column and a smooth surface to decrease the friction between the flat base 50 and the spacer column support component 22.

The relationships of the components in the spacer support assembly are shown in FIG. 4. The spacer column support component 22 includes a guide slot 60 embossed into at least a portion of its top surface. The guide slot 60 aligns the flat base 50 portion of the last (lowest) spacer 16 to the central axis of the spacer column support component 22. A receptacle 62 is created within the spacer column support component 22 and passes through at least a portion of the spacer column support component 22 and is used to capture the vertical channel 18, when used, and to maintain the alignment of the spacer column 12 and vertical channel 18. The opening or void in the spacer column support component 22 also confines the inward lateral movement of the spacer column 12 by capturing the protrusion 34 of the last (lowest) spacer 16 in the column 12. The outward lateral movement of the spacer column 12 is restricted by the innermost surface of the vertical channel 18. The interface between the flat base 50 and guide slot 60 can be enhanced by using surface enhancement techniques (like polishing, grinding, selective coating, etc . . . ) in order to minimize friction and therefore allow the spacer support columns 12 to move more freely in the desired axis. Furthermore, small bearings or other structures can be incorporated at this interface to reduce friction even more if desired.

A side view of an exemplary spacer column support component 22 is shown in FIG. 5, detailing the relationship of the captured protrusion 34 of the last (lowest) spacer 16 in the spacer column 12 and the guide slot 60 in the spacer column support component 22. A portion 70 of the interlocked spacers 16 resides within the vertical channel 18 keeping the spacers 16 aligned (collinear) and oriented in a preferential direction towards the center of the heating element coil, while still being allowed to move slideably inward and outward on an axis perpendicular to the tangent of the heating element coil diameter and the vertical spacer column 12. The maximum distance that the spacer 16 may move outward from the center of the heating element coil is defined by the space 72 between the outer surface of the spacer 16 and the inner surface of the vertical support 18. This maximum movement inward toward the center of the heating element coil is limited by the interference of the innermost surface of the spacer protrusion 34 and the receptacle in the spacer column support component 22.

In FIG. 5, the wire is supported above the lower surface of the spacer column support component 22 at a distance, D. This allows the wire to be free radiating and not in contact with the surface on which the spacer column support component rests. An example of a suitable distance is 9.35 mm.

Figure 6:
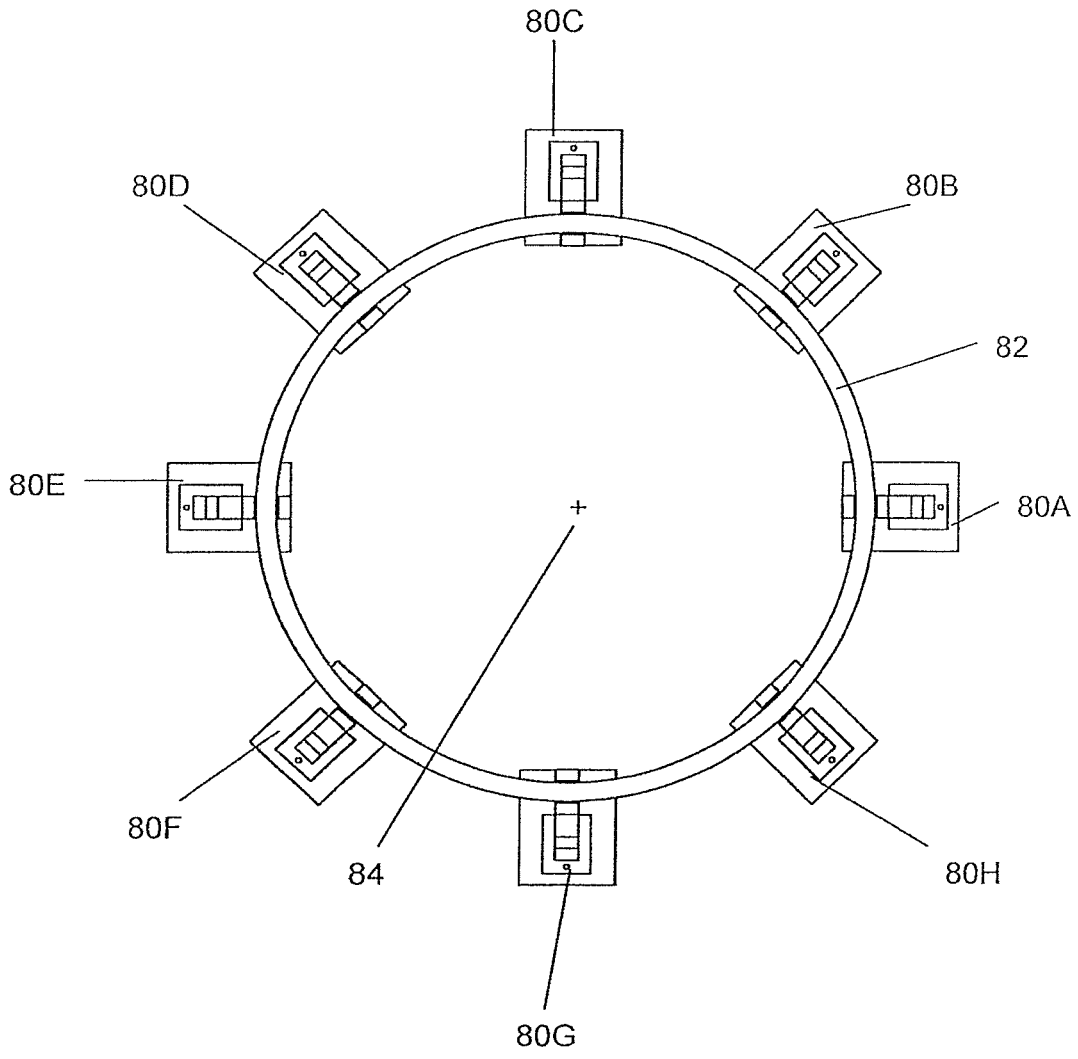
FIG. 6 is a plan view showing the arrangement of the vertical element support structures arranged around the circumference of a heating coil structure.

Referring to FIG. 6, several columns of vertical element support structures 80A-80H are arranged around the circumference of a heating coil structure 82. The arrangement is equidistant along the circumference from a central position 84 and in opposing pairs (i.e. 80A to 80E, 80B to 80F, etc . . . ). The vertical element support structures 80A-80H are seen from the end at which the spacer column support component 22 is located, similar to that shown in FIG. 4.

Figure 7:
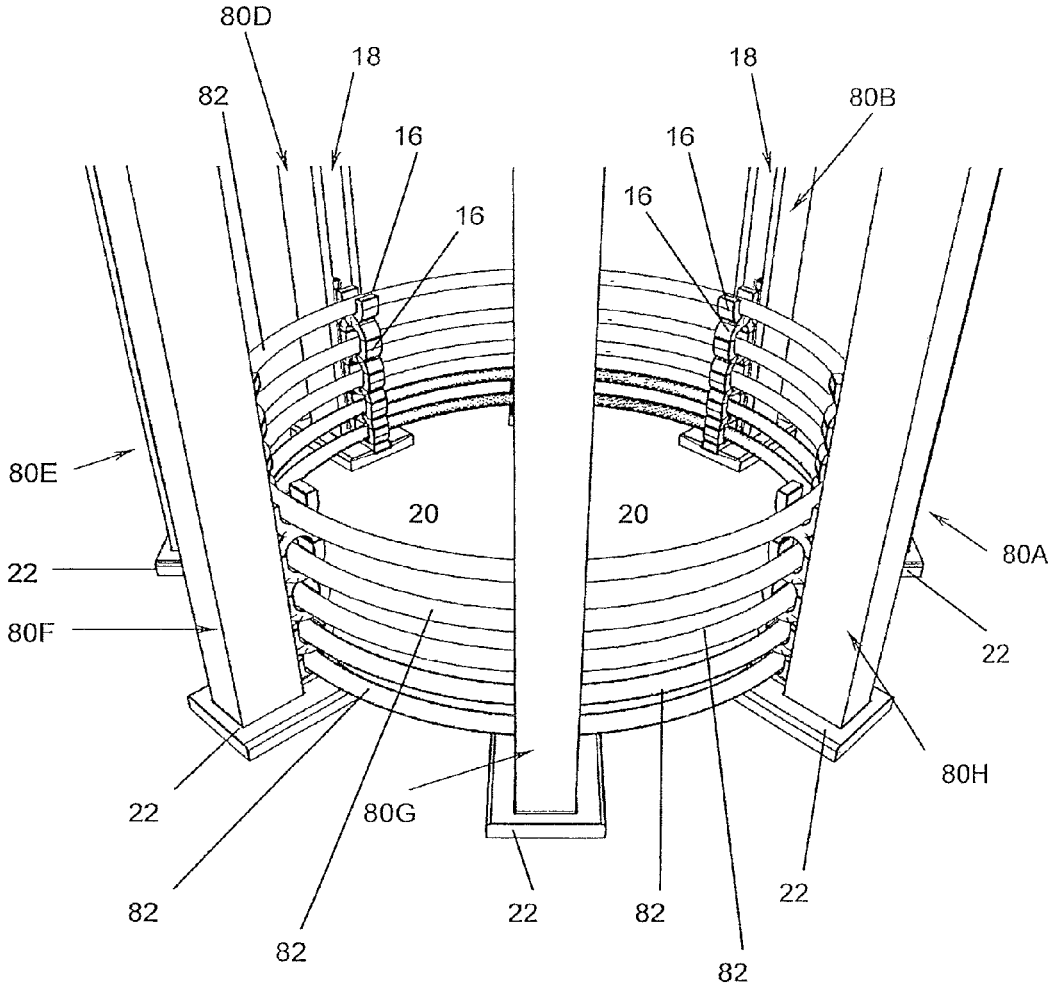
FIG. 7 is a perspective view of the arrangement of the vertical element support structures arranged around the circumference of a heating coil structure.

Referring to FIG. 7, vertical element support structures 80A-80H are shown in perspective view arranged around the circumference of a heating coil structure 82. The view illustrates an example of the coil 82 being held in the pocket 30 of a spacer 16. The spacers 16 are arranged in a vertical column 12 in the channel 18 of the vertical element support structures 80A-80H. Each of these features is not individually labeled in FIG. 7 for ease of viewing.

Figure 8:
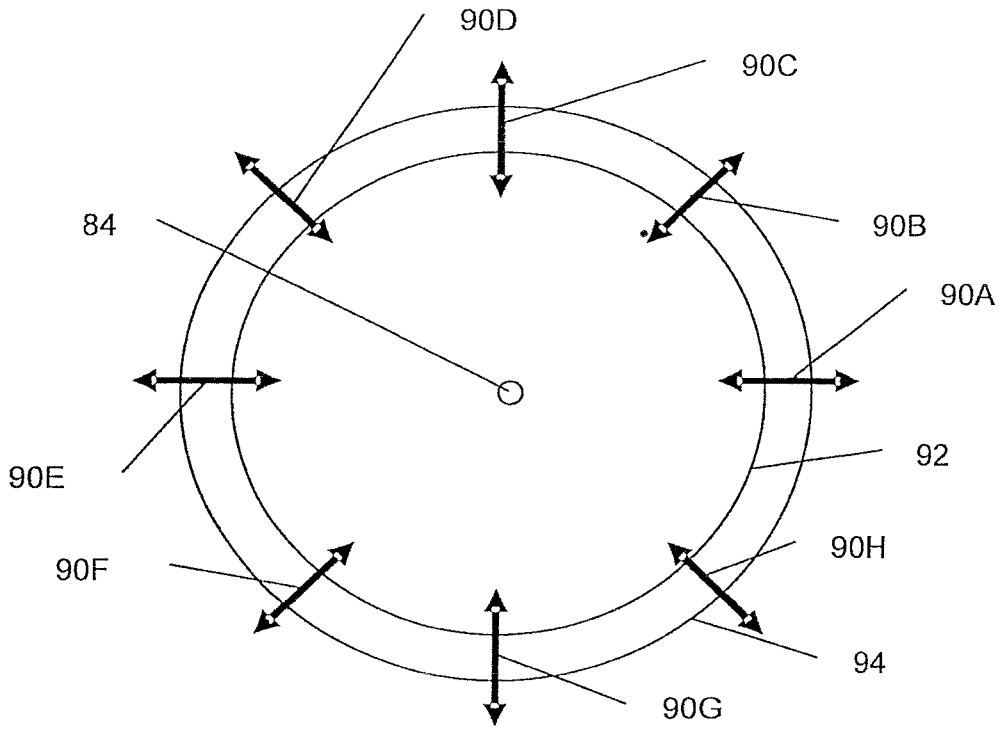
FIG. 8 is a diagram depicting the centering force vectors that act on the coil.

FIG. 8 schematically represents the forces and movement of the vertical element support structures (80A-80H in FIGS. 6 and 7) arranged around the circumference of the heating coil. Movement of the heating coil and the vertical element support structures are represented in idealized manner by arrows 90A-90H. As the temperature of heating element coil 82 increases, the coil length increases causing the coil diameter to increase and the mean diameter to move from a first position 92 to a second position 94. The vertical spacer columns 12 direct the movement outward relative from the center position 84 while maintaining the concentricity. At the same time, the adjacent coil loops remain interlocked, keeping the coil loops collinear and concentric. When the heating element cools and contracts, the mean diameter decreases from the second position 94 to the first position 92. The columns 12 of vertically supported spacers 16 direct the movement back to the center of the heating element assembly. Permanent elongation is accommodated in a similar manner where the heating element coil elongates over time, increasing the mean coil diameter. The columns 12 of vertical supported spacers 16 maintain the collinearity, concentricity & centering of the heating element assembly.

Figure 9A:
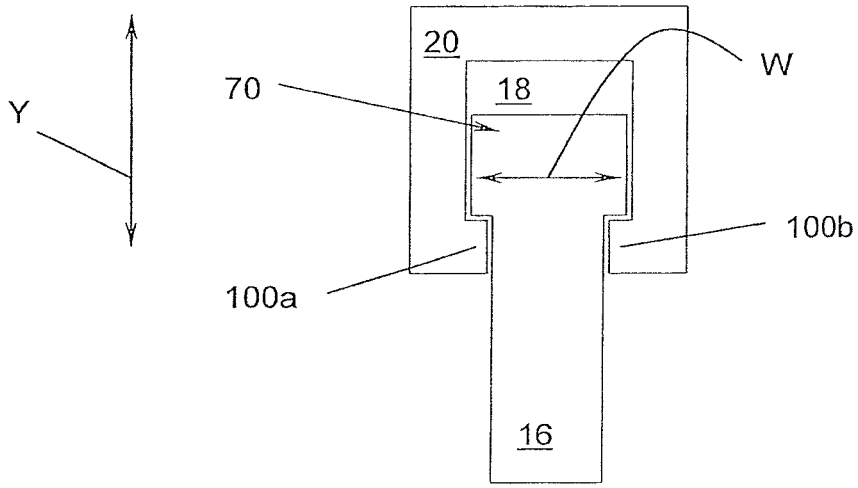
FIG. 9A is a plan view of an alternate spacer profile and interlocking means on two sides of the vertical channel.
Figure 9B:
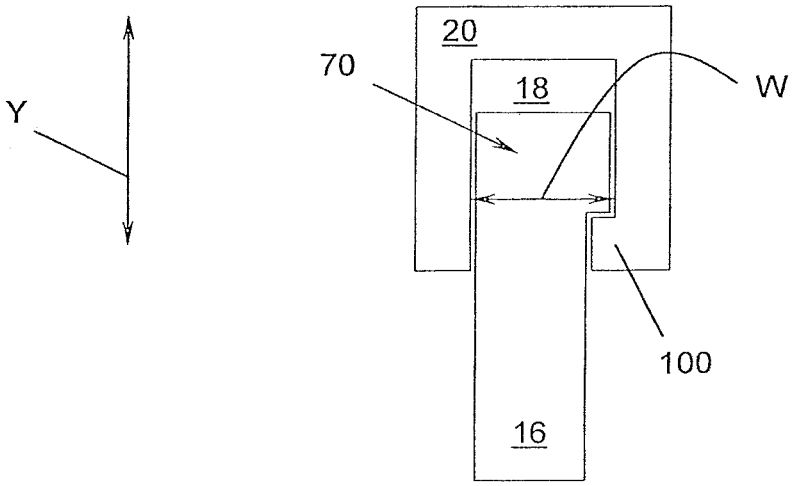
FIG. 9B is a plan view of an alternate spacer profile and interlocking means on one side of the vertical channel.

Alternate configurations for the spacer profile and the vertical channel can be employed. Two of these alternates are depicted in plan view in FIG. 9A and FIG. 9B. In FIGS. 9A and 9B, the spacers 16 fit slideably into vertical channel 18. The portion 70 of the spacers 16 residing within the vertical channel 18 is of a different width (W) than the rest of the spacer such that it is captured by a feature in the channel, such as a flange edge. In FIG. 9A, there are two such features, a first flange edge 100*a* and a second flange edge 100*b* and the spacer 16 is symmetrically captured by this features 100*a*, 100*b* in the channel 18, and in FIG. 9B there is one such feature 100 and the spacer 16 is asymmetrically captured by this feature 100 in the channel 18. The feature and the capturing limit the travel of the spacers 16 within the vertical channel 18 in a first direction, i.e., direction Y, in response to changes in diameter and/or position of the heating coil.

Either alternate configuration can be used in conjunction with or independent of the mechanism described in FIG. 4 and FIG. 5. Employing these alternate configurations has the benefit of reinforcing the maximum inward movement limit of the spacer rows. However, these alternate configurations can require installing the spacers by sliding the vertical channel over the spacers; therefore it is may be more difficult to replace a spacer within the column if it is broken.

It can be seen from the structure described that several advantageous features are created. Namely, a support structure is presented that allows for expansion and contraction of the heating element coil while keeping the spacer support columns aligned in a collinear arrangement constraining the adjacent loops of the heating element coil and keeping loops collinear, concentric, and maintaining the proper centering of the heating element coil in the assembly.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A support structure for a heating element coil interlocking adjacent loops of the coil so that they are retained in a collinear and concentric arrangement while allowing the loops of the coil to move freely inward and outward from the central axis in unison, the support structure comprising:

a plurality of vertical support column assemblies, each positioned around a circumference of the heating element coil, wherein each vertical support column assembly includes a plurality of individual spacers having a pitch, at least a portion of the vertical support column assembly residing at least partially inside a vertical channel of a stationary rail, wherein adjacent spacers include cooperating mating features and cooperating pocket forming features, the pocket forming features forming a pocket to enclose a loop of the coil, and wherein the vertical support column assembly moves slideably within the vertical channel in an axial direction parallel to the centerline and in a radial direction perpendicular to the centerline while cooperation of mating features on adjacent spacers are maintained.

2. The support structure according to claim 1, wherein the vertical channel is an integral part of the heating element insulation.

3. The support structure according to claim 2, wherein an inner surface of the vertical channel limits an outward movement of the vertical support column assemblies.

4. The support structure according to claim 1, wherein the vertical channel consists in part or in whole of a separate component.

5. The support structure according to claim 4, wherein an inner surface of the vertical channel limits an outward movement of the vertical support column assemblies.

6. The support structure according to claim 4, wherein the vertical channel is positioned by a recess in a column support component.

7. The support structure according to claim 6, wherein the column support component incorporates a means to restrict movement of the vertical support column assemblies to an axis intersecting the central vertical axis of the heating element coil.

8. The support structure according to claim 7, wherein the column support component limits an inward movement of the vertical support column assemblies.

9. The support structure according to claim 1, wherein the plurality of vertical support column assemblies are supported by a column support component.

10. The support structure according to claim 9, wherein the column support component incorporates a means to restrict movement of the vertical support column assemblies to an axis intersecting the central vertical axis of the heating element coil.

11. The support structure according to claim 10, wherein the column support component limits an inward movement of the vertical support column assemblies.

12. The support structure according to claim 1, wherein the portion of the spacer residing within the vertical channel is of a different width than the rest of the spacer and is captured by the channel.

13. The support structure according to claim 1, wherein the portion of the spacer residing within the vertical channel is of a different width than the rest of the spacer and is symmetrically captured by the channel.

14. A spacer for a vertical support structure of a heating element coil, comprising:

a mating feature including complimentary components on first opposing sides of the spacer;

a cavity, open to second opposing sides of the spacer; and an extension offset from an axis intersecting the mating features, the extension including a pocket sized to fit an individual loop of the heating element coil.

15. The spacer according to claim 14, wherein the cavity is positioned between the complimentary components.

16. The spacer according to claim 14, wherein the complimentary components are a protrusion and a recess.

17. The spacer according to claim 14, wherein a portion of the spacer opposing the extension is of a different width than the rest of the spacer.

18. The spacer according to claim 17, wherein the portion of the spacer having a different width is adapted for capture by a channel of a support structure for a heating element coil.

19. A method of controlling a position relative to a center position of a heating element coil upon heating, the method comprising:

mounting individual loops of a heating element coil in a column of vertically stacked spacers, wherein an increase in a length of the heating element coil upon heating is accommodated by a radially outward movement of the spacers relative to the center position while cooperation of mating features on adjacent spacers are maintained.

20. The method according to claim 19, wherein the radially outward movement of the spacers maintains the concentricity of the individual loops of the heating element coil.

21. The method according to claim 19, wherein the radially outward movement of the spacers maintains a collinearity, a concentricity and a centering of the heating element coil.

22. The method according to claim 19, wherein the spacer includes:

the mating features including complimentary components on first opposing sides of the spacer;

a cavity, open to second opposing sides of the spacer, and an extension offset from an axis intersecting the mating features, the extension including a pocket sized to fit an individual loop of the heating element coil.

23. The method according to claim 22, wherein the spacer includes a portion opposing the extension having a different width than the rest of the spacer, and the method includes capturing the portion in a channel of a support structure for a heating element coil.

24. The support structure of claim 1, wherein the pocket is sized relative to a cross-section of the coil to allow movement of the loops of the coil relative to the pocket.

25. The support structure of claim 1, wherein the cooperating mating features include a positive locking feature.

26. The support structure of claim 1, wherein the positive locking feature is a dove tail connection.

* * * * *